US009423761B2

(12) United States Patent
Sato

(10) Patent No.: US 9,423,761 B2
(45) Date of Patent: Aug. 23, 2016

(54) IMAGE FORMING DEVICE THAT FACILITATES MAINTENANCE OF WASTE TONER STORAGE MEMBER

(71) Applicant: Shougo Sato, Seto (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/067,248

(22) Filed: Oct. 30, 2013

(65) Prior Publication Data

US 2014/0119772 A1 May 1, 2014

(30) Foreign Application Priority Data

Oct. 31, 2012 (JP) ..... 2012-241111
Jun. 4, 2013 (JP) ..... 2013-117477

(51) Int. Cl.
*G03G 15/16* (2006.01)
*G03G 21/12* (2006.01)

(52) U.S. Cl.
CPC ..... *G03G 21/12* (2013.01); *G03G 15/161* (2013.01); *G03G 2215/1661* (2013.01); *G03G 2221/1684* (2013.01); *G03G 2221/1869* (2013.01)

(58) Field of Classification Search
USPC ..... 399/110
See application file for complete search history.

(56) References Cited

U.S. PATENT DOCUMENTS 7,221,887 B2 * 5/2007 Kimura et al. ..... 399/101
8,200,120 B2 6/2012 Sato
2005/0220480 A1 * 10/2005 Miyabe et al. ..... 399/111
2007/0122186 A1 * 5/2007 Kamimura ..... G03G 15/161 399/110
2008/0187378 A1 * 8/2008 Lim ..... 399/360
2009/0010661 A1 * 1/2009 Hamaya ..... 399/37
2009/0169252 A1 7/2009 Sato
2009/0214262 A1 * 8/2009 Jeon ..... G03G 15/0126 399/223
2009/0324284 A1 * 12/2009 Ohta ..... G03G 21/12 399/120
2011/0116831 A1 * 5/2011 Honobe et al. ..... 399/110
2011/0158693 A1 * 6/2011 Lee ..... G03G 15/0291 399/168
2012/0114367 A1 * 5/2012 Yagata et al. ..... 399/101
2013/0121728 A1 * 5/2013 Sakuma ..... 399/123

FOREIGN PATENT DOCUMENTS

JP 2009-157209 7/2009
JP 2010-008472 1/2010

* cited by examiner

*Primary Examiner* — Clayton E Laballe
*Assistant Examiner* — Linda B Smith
(74) *Attorney, Agent, or Firm* — Banner & Witcoff, Ltd.

(57) ABSTRACT

An image forming device includes: a cartridge; a supporting member; a belt unit; a waste toner storage member; and a conveying member. The cartridge is configured to retain a photosensitive body. The belt unit includes a belt; and a cleaning member. The cleaning member removes residual toner remaining on the belt. The waste toner storage member stores the residual toner. The belt unit is movable between a contact position in which the belt contacts the photosensitive body and a separated position in which the belt is separated from the photosensitive body. The conveying member allows the residual toner to be conveyed from the cleaning member to the waste toner storage member when the belt unit is in the contact position, and interrupts the residual toner from being conveyed from the cleaning member to the waste toner storage member when the belt unit is in the separated position.

20 Claims, 7 Drawing Sheets

IMAGE FORMING DEVICE THAT FACILITATES MAINTENANCE OF WASTE TONER STORAGE MEMBER

CROSS REFERENCE TO RELATED APPLICATION

This application claims priority from Japanese Patent Application No. 2012-241111 filed Oct. 31, 2012 and Japanese Patent Application No. 2013-117477 filed Jun. 4, 2013. The entire content of each of these priority applications is incorporated herein by reference.

TECHNICAL FIELD

The present invention relates to an electrophotographic image forming device.

BACKGROUND

A tandem-type color printer having photosensitive drums for the ink colors black, yellow, magenta, and cyan is known in the art as an electrophotographic image forming device.

One such color printer that has been proposed includes a plurality of developing devices, each of which has a photosensitive drum; an intermediate transfer belt opposing the tops of the developing devices; and a cleaning unit disposed above the intermediate transfer belt for collecting residual toner deposited on the belt.

Consequently, maintenance of the cleaning unit must be performed separately from maintenance on the developing devices, making maintenance of the cleaning unit more difficult.

SUMMARY

In view of the foregoing, it is an object of the present invention to provide an image forming device that facilitates maintenance of a waste toner storage member in the cleaning unit.

In order to attain the above and other objects, the present invention provides an image forming device includes a main body; a cartridge; a supporting member; a belt unit; a waste toner storage member; and a conveying member. The cartridge is configured to retain a photosensitive body extending in a longitudinal direction and having a longitudinal dimension. The supporting member is configured to support the cartridge. The belt unit includes a belt; and a cleaning member. The cleaning member is configured to remove residual toner remaining on the belt. The waste toner storage member is supported by the supporting member and configured to store the residual toner removed by the cleaning member. The conveying member is configured to convey the residual toner removed by the cleaning member to the waste toner storage member. The belt unit is configured to be movable between a contact position in which the belt contacts the photosensitive body and a separated position in which the belt is separated from the photosensitive body. The conveying member is provided in the belt unit, coupled to the waste toner storage member when the belt unit is disposed in the contact position, and separated from the waste toner storage member when the belt unit is disposed in the separated position. The convening member is formed with a first opening, and a first shutter member is configured to open the first opening when the belt unit is disposed in the contact position and close the first opening when the belt unit is disposed in the separated position. The waste toner storage member is formed with a second opening, and a second shutter member is configured to open the second opening when the belt unit is disposed in the contact position and close the second opening when the belt unit is disposed in the separated position.

According to another aspect, the present invention provides an image forming device includes a main body; a cartridge; a supporting member; a belt unit; a waste toner storage member; and a conveying member. The cartridge is configured to retain a photosensitive body extending in a longitudinal direction and having a longitudinal dimension. The supporting member is configured to support the cartridge. The belt unit includes a belt; and a cleaning member. The cleaning member is configured to remove residual toner remaining on the belt. The waste toner storage member is supported by the supporting member and configured to store the residual toner removed by the cleaning member. The conveying member is configured to convey the residual toner removed by the cleaning member to the waste toner storage member. The belt unit is configured to be movable between a contact position in which the belt contacts the photosensitive body and a separated position in which the belt is separated from the photosensitive body. The conveying member is configured to allow the residual toner to be conveyed from the cleaning member to the waste toner storage member when the belt unit is in the contact position, and interrupt the residual toner from being conveyed from the cleaning member to the waste toner storage member when the belt unit is in the separated position.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
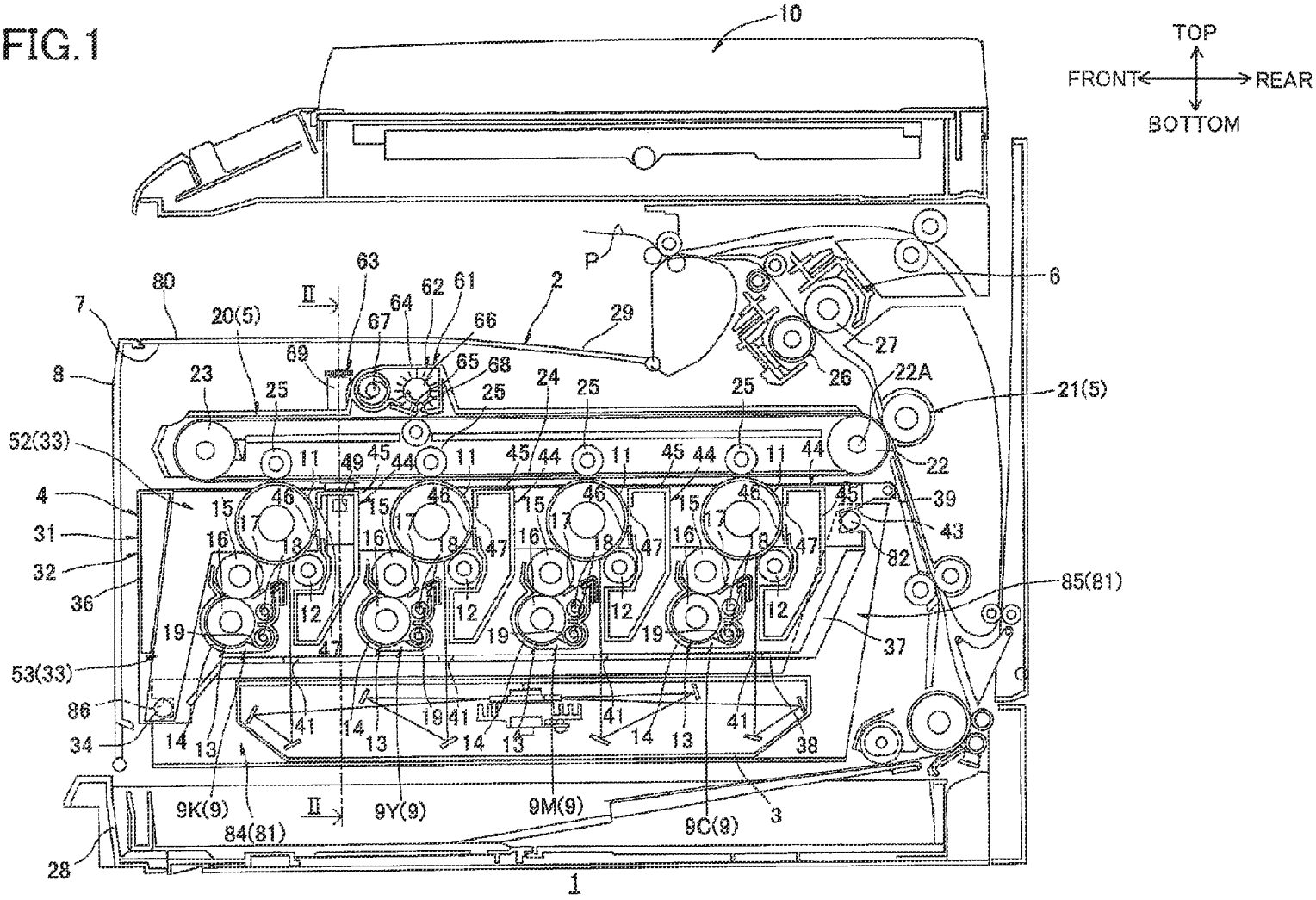
FIG. 1 is a vertical cross-sectional view of a printer according to a first embodiment of an image-forming device of the present invention.

A printer according to embodiments of the present invention will be described while referring to the accompanying drawings wherein like parts and components are designated by the same reference numerals to avoid duplicating description.

1. Overall Structure of a Printer

A printer 1 shown in FIG. 1 is a horizontal tandem-type intermediate transfer color printer.

In the following description, upward and downward directions related to the printer 1 will be given based on the state of the printer 1 when the printer 1 is resting on a level surface. Hence, the side of the printer 1 at the top of FIG. 1 will be considered the upper side, and the side at the bottom will be considered the lower side. Further, the left side of the printer 1 in FIG. 1 will be considered the front side, and the right side will be considered the rear side. Left and right sides of the printer 1 will be based on the perspective of a user facing the front of the printer 1. Hence, the near side of the printer 1 in FIG. 1 will be considered the right side, and the far side will be considered the left side.

The printer 1 is provided with a main casing 2 and, within the main casing 2, a process unit 4, a scanning unit 3, a transfer unit 5, and a fixing unit 6. The printer 1 also includes an image-reading unit 10 disposed above the main casing 2.

The main casing 2 has a box-like shape and is generally rectangular in a side view. An access opening 7 is formed in the front side of the main casing 2. A front cover 8 is pivotally provided on the front of the main casing 2 over the access opening 7. The front cover 8 can be pivoted about its lower edge between a closed position (see FIG. 1) for covering the access opening 7, and an open position (see FIG. 4) for exposing the access opening 7. An upper cover 80 is provided on the top of the main casing 2 and is capable of pivoting about its rear edge. The upper cover 80 pivots along with pivoting of a belt unit 20 described later.

The process unit 4 is disposed in the vertical center of the main casing 2. The process unit 4 includes a process frame 31, and process cartridges 9.

The process frame 31 has a frame-like structure with a closed bottom. The plurality of process cartridges 9 is retained inside the process frame 31. The process frame 31 is capable of moving in the front-rear direction between a mounted position (see FIG. 1) mounted inside the main casing 2, and a withdrawn position (see FIG. 4) withdrawn to the outside of the main casing 2.

The process cartridges 9 are arranged parallel to each other and are spaced at intervals in the front-rear direction. Specifically, the process cartridges 9 are juxtaposed in the front-rear direction and include, in order from the front side toward the rear side, a black process cartridge 9K, a yellow process cartridge 9Y, a magenta process cartridge 9M, and a cyan process cartridge 9C. Each of the process cartridges 9 integrally retains a photosensitive drum 11, a charging roller 12, and a developing device 13.

Each photosensitive drum 11 is rotatably supported in the top end of the corresponding process cartridge 9 with its top surface exposed in the top end of the process cartridge 9. The photosensitive drums 11 have a general cylindrical shape and are oriented with their axes in the left-right direction. Hence, the longitudinal direction of the photosensitive drums 11 is aligned in the left-right direction.

Each charging roller 12 is disposed on the lower rear side of the corresponding photosensitive drum 11 and contacts the photosensitive drum 11 on the lower rear side.

Each developing device 13 is disposed on the lower front side of the correspond photosensitive drum 11. The developing device 13 includes a developer frame 14, and a developing roller 15.

The developer frame 14 is formed in a cylindrical shape and is elongated in the left-right direction. In cross section, the developer frame 14 has a general U-shape, with the opening of the "U" on the top.

The developing roller 15 is rotatably supported in the top end of the developer frame 14, with its upper peripheral surface exposed through the top of the developer frame 14. The developing roller 15 contacts the photosensitive drum 11 from the lower front side.

The developing device 13 is further provided with a supply roller 16 for supplying toner to the developing roller 15, and a thickness-regulating blade 17 for regulating the thickness of toner carried on the developing roller 15. A toner-accommodating chamber 19 that accommodates toner is disposed in space provided on the rear side of the supply roller 16. The toner-accommodating chamber 19 is divided vertically into two spaces. An auger screw 18 is disposed in each of the spaces.

The auger screws 18 are aligned in the left-right direction. The auger screws 18 function to circulate toner in the toner-accommodating chamber 19.

The scanning unit 3 is disposed beneath the process unit 4 for confronting the lower side of the process unit 4 when the process unit 4 is in the mounted position. The scanning unit 3 irradiates laser beams toward the photosensitive drums 11 based on image data, as indicated by solid lines in the drawing.

The transfer unit 5 is disposed above the process unit 4 when the process unit 4 is in the mounted position. The transfer unit 5 includes a belt unit 20, and a secondary transfer roller 21.

The belt unit 20 is elongated in the front-rear direction so as to confront the top sides of all photosensitive drums 11. The belt unit 20 includes a drive roller 22, a follow roller 23, an intermediate transfer belt 24, and four primary transfer rollers 25.

The drive roller 22 is rotatably supported in the rear end of the belt unit 20.

The follow roller 23 is rotatably supported in the front end of the belt unit 20.

The intermediate transfer belt 24 is looped around the drive roller 22 and follow roller 23 so that the lower portion of the loop contacts the top peripheral surfaces of all photosensitive drums 11. When the drive roller 22 is driven to rotate, the intermediate transfer belt 24 circulates so that its lower portion moves rearward, and the follow roller 23 rotates along with the circulating movement of the intermediate transfer belt 24.

The primary transfer rollers 25 are arranged parallel to each other and are spaced at intervals in the front-rear direction. More specifically, the primary transfer rollers 25 are disposed between the drive roller 22 and follow roller 23 within the loop of the intermediate transfer belt 24 at positions above the corresponding photosensitive drums 11. The primary transfer rollers 25 contact the lower portion of the intermediate transfer belt 24 from above.

The belt unit 20 is also capable of pivoting about a rotational shaft 22A of the drive roller 22. The belt unit 20 can pivot between a contact position (see FIG. 1) in which the intermediate transfer belt 24 contacts all photosensitive drums 11, and a separated position (see FIG. 4) in which the intermediate transfer belt 24 is separated from all photosensitive drums 11.

The secondary transfer roller 21 is disposed on the rear side of the drive roller 22, with the intermediate transfer belt 24 interposed therebetween.

The fixing unit 6 is disposed above the secondary transfer roller 21. The fixing unit 6 includes a heating roller 26, and a pressure roller 27 confronting the heating roller 26.

The image-reading unit 10 is disposed above the main casing 2, with a gap formed between the bottom of the image-reading unit 10 and the top of the upper cover 80. The image-reading unit 10 functions to read image data from an original.

When a print job is inputted into the printer 1, toner in the developing device 13 is tribocharged between the supply roller 16 and developing roller 15, and the developing roller 15 carries a thin layer of toner on its surface, regulated at a uniform thickness by the thickness-regulating blade 17.

In the meantime, the charging roller 12 applies a uniform charge to the surface of the photosensitive drum 11. Subsequently, the scanning unit 3 exposes the surface of the photosensitive drum 11 based on prescribed image data, forming an electrostatic latent image on the surface of the photosensitive drum 11 based on the image data. Next, the toner carried on the surface of the developing roller 15 is supplied to the latent image formed on the surface of the photosensitive drum 11, developing the latent image into a toner image.

Toner images carried on the surfaces of all photosensitive drums 11 are sequentially transferred onto the lower portion of the intermediate transfer belt 24. This operation forms a color image on the surface of the intermediate transfer belt 24.

A paper tray 28 is provided in the bottom section of the main casing 2 for accommodating sheets of paper P. Various rollers provided in the main casing 2 convey the paper P between the intermediate transfer belt 24 and secondary transfer roller 21 one sheet at a time and at a prescribed timing. The color image formed on the intermediate transfer belt 24 is transferred onto the sheet as the sheet passes in an upward direction between the intermediate transfer belt 25 and secondary transfer roller 21.

Next, the sheets of paper P pass between the heating roller 26 and pressure roller 27 in the fixing unit 6. The heating roller 26 and pressure roller 27 apply heat and pressure to the paper P, fixing the color image to the paper P.

Subsequently, the various rollers convey the sheets of paper P forward and discharge the sheets onto a discharge tray 29 provided on the supper cover 80 of the main casing 2.

2. Detailed Description of the Process Unit (1) Process Frame

Figure 2:
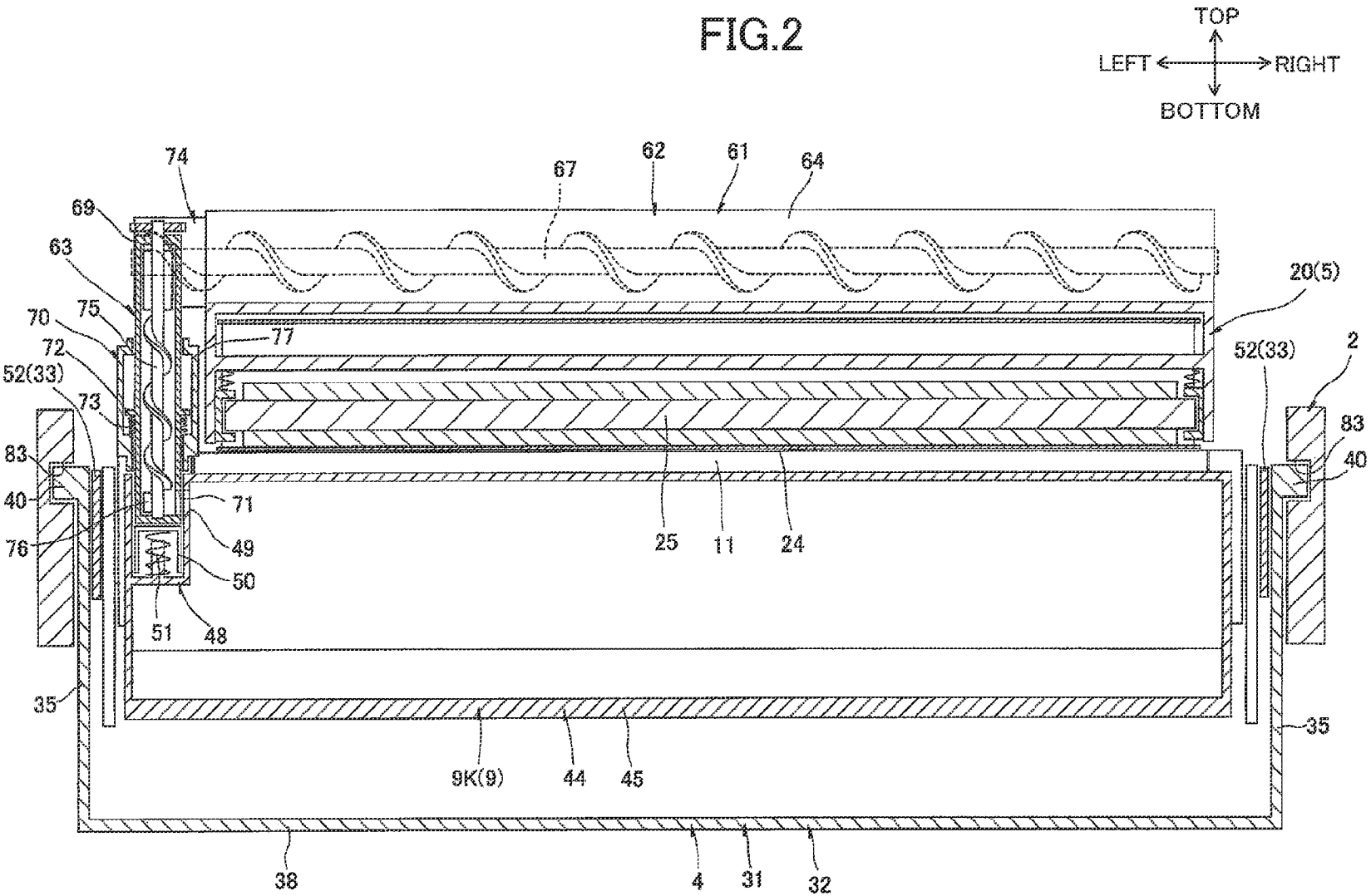
FIG. 2 is a cross-sectional view taken along a II-II line of FIG. 1.

As shown in FIGS. 1 and 2, the process frame 31 includes a frame body 32, a pair of left and right process-side positioning plates 33, and a process-side positioning shaft 34.

The frame body 32 is formed of a hard resin material. The frame body 32 has a frame-like structure with a closed bottom and open top. The frame body 32 includes a pair of left and right side walls 35, a front wall 36, a rear wall 37, and a bottom wall 38.

The side walls 35 are disposed so as to confront each other across a gap in the left-right direction. The side walls 35 have a generally flat plate shape that extends both vertically and in the front-rear direction. Each side wall 25 includes a guide roller 39, and a guide rail 40.

The guide roller 39 is rotatably disposed in the upper rear corner of the respective side wall 35.

The guide rail 40 is formed on the top edge of the side wall 35 and extends in the front-rear direction. The guide rail 40 protrudes outward in the left-right direction to form a ridge-like shape.

The front wall 36 bridges the front ends of the side walls 35. The front wall 36 has a generally flat plate shape and is elongated both vertically and in the left-right direction.

The rear wall 37 bridges the rear ends of the side walls 35. The rear wall 37 has a generally flat plate shape and is elongated both vertically and in the left-right direction.

The bottom wall 38 bridges the bottom edges of the side walls 35. The bottom wall 38 has a generally flat plate shape and is elongated in the front-rear and left-right directions. A plurality of through-holes 41 is formed in the bottom wall 38.

The through-holes 41 penetrate the bottom wall 38 at positions below the photosensitive drums 11.

The process-side positioning plates 33 are disposed at positions confronting the inner left and right sides of the respective side walls 35. The process-side positioning plates 33 are formed of metal, such as stainless steel or steel. The process-side positioning plates 33 have a general L-shape in a side view. Specifically, each process-side positioning plate 33 is configured of a body part 52, and an extended part 53.

Each body part 52 is positioned on the inside of the upper edge on the corresponding side wall 35 with respect to the left-right direction. The body part 52 has a flat plate shape that is generally rectangular in a side view and extends in the front-rear direction, spanning nearly the entire front-rear dimension of the side wall 35. The body part 52 includes a fitting groove 43.

The fitting groove 43 is cut out from the rear edge of the body part 52 to form a general U-shape in a side view that is open on the rear side.

Each extended part 53 is positioned inside the front end of the corresponding side wall 35 with respect to the left-right direction. The extended part 53 has a flat plate shape that is generally rectangular in a side view. The extended part 53 extends continuously downward from the lower edge on the front end of the body part 52, spanning nearly the entire vertical dimension of the side wall 35.

The process-side positioning shaft 34 is provided in the lower front corner of the process frame 31 and penetrates the bottom ends of the extended parts 53 and the lower front corners of the side walls 35. The process-side positioning shaft 34 is formed of metal, such as stainless steel. The process-side positioning shaft 34 has a general rod shape and extends in the left-right direction. The left and right ends of the process-side positioning shaft 34 protruded outward in the corresponding left and right directions from the outer left and right surfaces of the side walls 35.

(2) Drum Cleaners

Each process cartridge 9 is also provided with a drum cleaner 44.

The drum cleaner 44 is disposed on the rear side of the corresponding photosensitive drum 11. The drum cleaner 44 includes a waste toner storage unit 45, and a scraping blade 46.

The waste toner storage unit 45 has a box-like shape and extends in the vertical and left-right directions. A collection opening 47 is formed in the waste toner storage unit 45.

The collection opening 47 penetrates the front wall of the waste toner storage unit 45 at the top portion thereof.

The scraping blade 46 has a generally flat plate shape and is elongated in the left-right direction. The bottom edge, i.e., base edge, of the scraping blade 46 is supported on the bottom peripheral edge defining the collection opening 47 formed in the waste toner storage unit 45. The top edge, i.e., the free edge of the scraping blade 46 contacts the peripheral surface of the photosensitive drum 11.

The drum cleaner 44 provided for the black process cartridge 9K also includes a receiving part 48.

The receiving part 48 is provided in the upper left portion of the drum cleaner 44 corresponding to the black process cartridge 9K. The receiving part 48 has a general cylindrical shape, with a closed bottom, and is elongated vertically. The receiving part 48 includes a drum-cleaner-side through-hole 49, and a drum-cleaner-side shutter 50.

The drum-cleaner-side through-hole 49 has a generally rectangular shape in a side view and penetrates the right wall of the receiving part 48 in the upper portion thereof.

The drum-cleaner-side shutter 50 is provided inside the receiving part 48. The drum-cleaner-side shutter 50 has a general cylindrical shape, with a closed top, and is elongated vertically. The vertical dimension of the drum-cleaner-side shutter 50 is approximately half that of the receiving part 48. The drum-cleaner-side shutter 50 is capable of sliding between an open position (see FIG. 2) in which the drum-cleaner-side shutter 50 is disposed ins the lower end of the receiving part 48 for opening the drum-cleaner-side through-hole 49, and a closed position (see FIG. 4) in which the drum-cleaner-side shutter 50 is disposed in the upper end of the receiving part 48 for closing the drum-cleaner-side through-hole 49. A compression spring 51 is interposed between the bottom wall of the receiving part 48 and the top wall of the drum-cleaner-side shutter 50 for constantly urging the drum-cleaner-side shutter 50 upward toward the closed position.

3. Detailed Description of the Belt Unit (1) Belt Cleaner

The belt unit 20 is also provided with a belt cleaner 61.

The belt cleaner 61 includes a cleaning unit 62, and a conveying unit 63.

The cleaning unit 62 is disposed above the intermediate transfer belt 24 at a position aligned with the yellow process cartridge 9Y. The cleaning unit 62 includes a cleaner frame 64, a scraping blade 65, a scraping brush 66, and an auger screw 67.

The cleaner frame 64 is box-shaped and generally rectangular in a side view. The cleaner frame 64 is further provided with a collection hold 68 formed therein, and a connecting part 74 provided thereon.

The collection hole 68 penetrates the bottom wall of the cleaner frame 64 at the rear end thereof.

The connecting part 74 has a general cylindrical shape with a closed left end. The connecting part 74 protrudes leftward from the left wall of the cleaner frame 64 at the front end thereof. The right end of the connecting part 74 is in communication with the cleaner frame 64.

The scraping blade 65 has a generally flat plate shape that is elongated in the left-right direction. The front edge, i.e., the base edge of the scraping blade 65 is supported on the front peripheral edge defining the collection hole 68 formed in the cleaner frame 64. The rear edge, i.e., the free end of the scraping blade 65 contacts the top surface on the upper portion of the intermediate transfer belt 24.

The scraping brush 66 is disposed in the rear side of the cleaner frame 64 and confronts the collection hole 68 from above. The lower side of the scraping brush 66 contacts the top surface of the scraping blade 65 from above.

The auger screw 67 is disposed in the rear end of the cleaner frame 64 on the front side of the scraping brush 66. The auger screw 67 is elongated in the left-right direction. The right end of the auger screw 67 is rotatably supported in the right wall of the cleaner frame 64, and the left end of the auger screw 67 is rotatably supported in the left wall of the connecting part 74.

Figure 3:
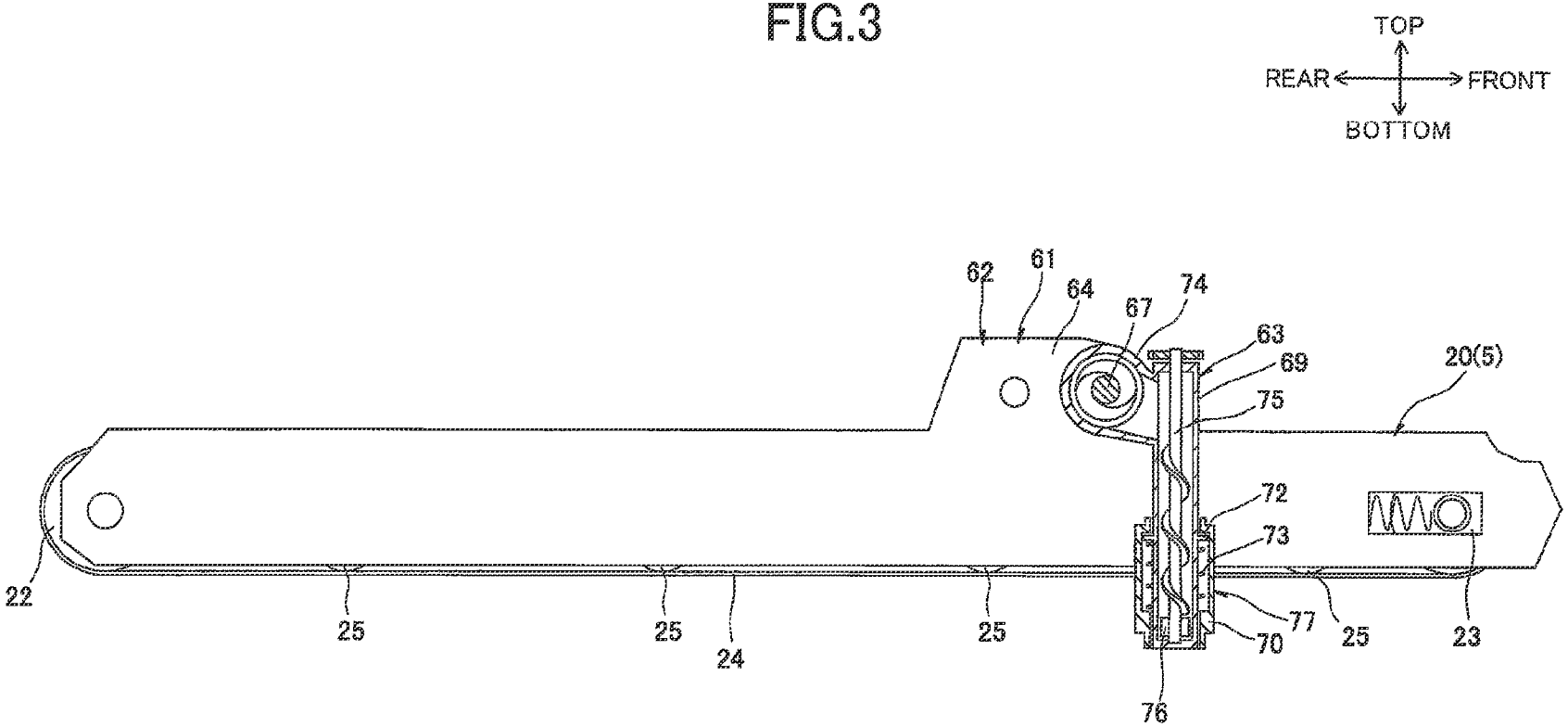
FIG. 3 is a cross-sectional view of a conveying unit shown in FIG. 1.

The conveying unit 63 is disposed on the left side of the intermediate transfer belt 24 and is aligned vertically with the drum cleaner 44 of the black process cartridge 9K. As shown in FIGS. 2 and 3, the conveying unit 63 includes a conveying cylinder 69, an auger screw 75, and a belt-cleaner-side shutter 70.

The conveying cylinder 69 has a general cylinder shape that is elongated vertically and closed on both ends. The rear side of the conveying cylinder 69 at its upper end is connected to the front side of the connecting part 74 constituting the cleaning unit 62. The top end of the conveying cylinder 69 is in communication with the connecting part 74. The conveying cylinder 69 also has a belt-cleaner-side communication hole 71, and a flange part 72.

The belt-cleaner-side communication hole 71 is generally rectangular in a side view and penetrates the right wall of the conveying cylinder 69 at the lower end thereof.

The flange part 72 is formed around the entire circumference of the conveying cylinder 69 at substantially the vertical center thereof and protrudes radially outward from the outer peripheral surface of the conveying cylinder 69 to form a ridge.

The auger screw 75 is provided in the conveying cylinder 69 in a vertical orientation. The top end of the auger screw 75 is rotatably supported in the top wall of the conveying cylinder 69, and the bottom end is rotatably supported in the bottom wall of the conveying cylinder 69. The auger screw 75 further includes a blade 76.

The blade 76 is provided on the bottom end of the auger screw 75 at a position corresponding to the belt-cleaner-side communication hole 71 in the left-right direction. The blade 76 has a generally flat plate shape that extends radially outward from the rotational shaft of the auger screw 75.

The belt-cleaner-side shutter 70 is fitted around the lower end of the conveying cylinder 69. The belt-cleaner-side shutter 70 has a generally cylindrical shape and extends vertically. The belt-cleaner-side shutter 70 is capable of sliding vertically between an open position (see FIG. 2) for exposing the belt-cleaner-side communication hole 71 formed in the conveying cylinder 60, and a closed position (see FIG. 3) for closing the belt-cleaner-side communication hole 71. The belt-cleaner-side shutter 70 also has a spring-accommodating section 77.

The spring-accommodating section 77 is formed in the vertical center of the belt-cleaner-side shutter 70 to provide this center region with an expanded diameter. The flange part 72 of the conveying cylinder 69 is fitted inside the spring-accommodating section 77.

A compression spring 73 is interposed between the bottom surface of the flange part 72 and the bottom side on the inner peripheral surface of the spring-accommodating section 77. The compression spring 73 constantly urges the belt-cleaner-side shutter 70 downward toward the closed position.

(2) Coupled State of the Belt Cleaner and Drum Cleaners

When the process unit 4 is in its mounted position and the belt cleaner 61 is disposed in the contact position, the bottom end of the conveying cylinder 69 is fitted into the receiving part 48 of the drum cleaner 44, as shown in FIG. 2. In this way, the conveying unit 63 is coupled to the waste toner storage unit 45 of the black process cartridge 9K.

At this time, the bottom end of the belt-cleaner-side shutter 70 is in contact with the top end of the receiving part 48 and, thus, the belt-cleaner-side shutter 70 is disposed in its open position against the urging force of the compression spring 73.

Further, the bottom end of the conveying cylinder 69 is in contact with the top end of the drum-cleaner-side shutter 50, placing the drum-cleaner-side shutter 50 in its open position against the urging force of the compression spring 51.

In this state, the belt-cleaner-side communication hole 71 opposes the drum-cleaner-side through-hole 49.

4. Main Casing

Figure 4:
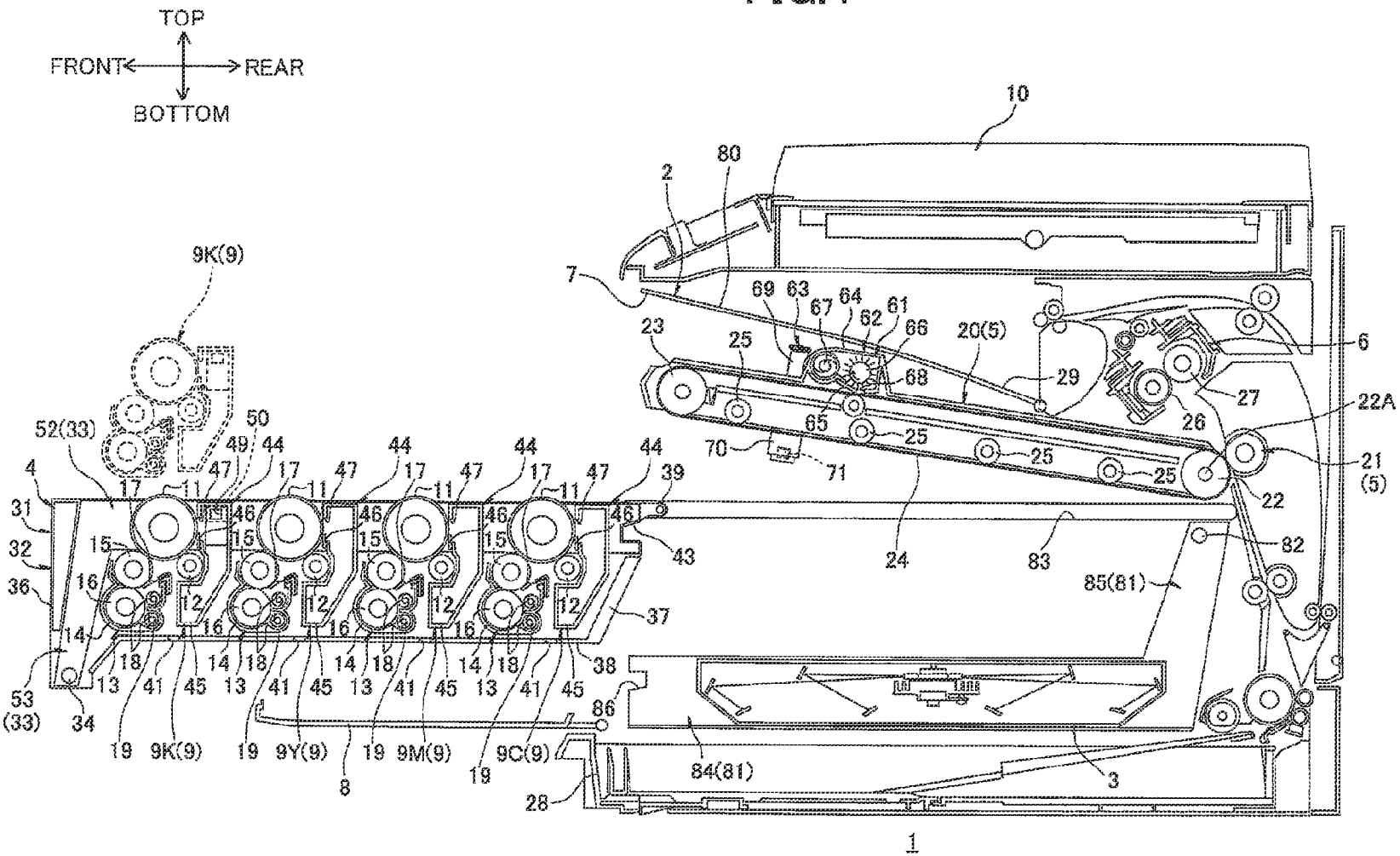
FIG. 4 is an explanatory diagram showing a mounting and removing operation of a process cartridge shown in FIG. 1.

As shown in FIGS. 2 and 4, guide grooves 83 are formed on the inside of the main casing 2.

The guide grooves 83 are recessed grooves formed one in each of the inner left and right surfaces on the corresponding left and right side walls of the main casing 2. The guide grooves 83 are substantially linear, extending in the front-rear direction beneath the belt unit 20. The guide rollers 39 and guide rails 40 of the process unit 4 are fitted into the corresponding guide grooves 83.

As shown in FIG. 1, the main casing 2 is also provided with a pair of left and right body-side positioning plates 81, and a body-side positioning shaft 82.

The body-side positioning plates 81 are respectively positioned within the main casing 2 on the left-right outer sides of the scanning unit 3 so as to oppose the left-right outer sides. The body-side positioning plates 81 are formed of metal, such as stainless steel or steel. The body-side positioning plates 81 have a general L-shape in a side view. Each body-side positioning plate 81 includes a body part 84, and an extended part 85.

The body parts 84 are disposed in positions opposing the outer left and right sides of the scanning unit 3. The body parts 84 have a flat plate shape that is generally rectangular in a side view and has approximately the same front-rear dimension as the process unit 4. Each body part 84 includes a fitting groove 86.

The fitting groove 86 is formed in the front edge of the corresponding body part 84 so as to recess rearward from the front edge. The fitting groove 86 has a general U-shape in a side view and is open on the front side.

The extended parts 85 have a flat plate shape and are generally rectangular in a side view. The extended parts 85 extend continuously upward from the top edges of the body parts 84 at the rear ends of the same. The top ends of the extended parts 85 are positioned lower than the rear ends of the guide grooves 83 formed in the main casing 2.

The body-side positioning shat 82 bridges the upper ends of the extended parts 85. The body-side positioning shaft 82 is formed of a metal, such as stainless steel or steel. The body-side positioning shaft 82 has a general rod shape and is oriented in the left-right direction.

5. Cleaning Operation

During an image-forming operation on the printer 1 described above, the drum cleaners 44 clean the surfaces of the respective photosensitive drums 11, and the belt cleaner 61 cleans the surface of the intermediate transfer belt 24.

In some cases, not all toner in the toner images carried on the surfaces of the photosensitive drums 11 is transferred onto the lower portion of the intermediate transfer belt 24 during the image-forming operation described above. In the following description, toner that is not transferred from the surfaces of the photosensitive drums 11 will be called "residual toner."

As each photosensitive drum 11 continues to rotate clockwise in a right side view after transfer operation, the scraping blade 46 of the corresponding drum cleaner 44 scrapes off any residual toner remaining on the surface of the photosensitive drum 11.

Residual toner scraped off the photosensitive drum 11 by the scraping blade 46 falls through the collection opening 47 and is stored in the waste toner storage unit 45.

Residual toner may also be left on the surface of the intermediate transfer belt 24 when a color image carried on the surface of the intermediate transfer belt 24 is transferred onto the paper P in the image-forming operation described above.

As the intermediate transfer belt 24 continues to circulate after the transfer operation, the scraping blade 65 of the belt cleaner 61 scrapes off any residual toner remaining on the surface of the intermediate transfer belt 24.

Residual toner scraped off the intermediate transfer belt 24 by the scraping blade 65 is conveyed through the collection hole 68 by the rotating scraping brush 66, and is collected in the front end of the cleaner frame 64.

Residual toner collected in the cleaner frame 64 is conveyed leftward by the rotating auger screw 67 and supplied through the connecting part 74 into the top end of the conveying cylinder 69.

Toner supplied into the conveying cylinder 69 is conveyed downward by its own weight and by the rotating auger screw 75. The toner is then conveyed through the belt-cleaner-side communication hole 71 and drum-cleaner-side through-hole 49 by the blade 76 and stored in the waste toner storage unit 45. Hence, while the belt unit 20 is disposed in the contact position, the conveying unit 63 allows residual toner to be conveyed from the cleaning unit 62 to the waste toner storage unit 45 of the black process cartridge 9K.

6. Mounting and Removing the Process Cartridges

To remove a process cartridge 9 from the main casing 2, first the operator opens the front cover 8 and lifts the front end of the belt unit 20 upward.

Consequently, the belt unit 20 pivots clockwise in a right side view about the rotational shaft 22A of the drive roller 22, as shown in FIG. 4, moving to its separated position. The upper cover 80 follows the pivoting belt unit 20 by pivoting clockwise in a right side view about its rear edge.

Through this operation, the intermediate transfer belt 24 separates from the top surfaces of the photosensitive drums 11. The conveying cylinder 69 also moves upward, separating from the waste toner storage unit 45 of the black process cartridge 9K. Hence, the conveying cylinder 69 is extracted from the receiving part 48.

Thus, when the belt unit 20 is shifted into its separated position, the conveying unit 63 moves upward together with the belt unit 20 and is retracted from the path of the process unit 4.

As a result, the urging force of the compression spring 73 moves the belt-cleaner-side shutter 70 into its closed position, and the urging force of the compression spring 51 moves the drum-cleaner-side shutter 50 into its closed position.

This action blocks the conveyance of residual toner from the cleaning unit 62 to the waste toner storage unit 45 of the black process cartridge 9K.

Next, to remove the process cartridge 9 from the main casing 2, the operator pulls the process unit 4 forward out of the main casing 2.

Through this operation, the process-side positioning shaft 34 is extracted from the fitting grooves 86 formed in the body-side positioning plates 81 and the body-side positioning shaft 82 is extracted from the fitting grooves 43 formed in the process-side positioning plates 33, as the process unit 4 is shifted into the withdrawn position.

Next, the operator pulls the process cartridge 9 upward out of the process frame 31, thereby completing the operation to remove a process cartridge 9 from the main casing 2.

In order to mount a process cartridge 9 in the main casing 2, the operation for removing a process cartridge 9 described above is performed in reverse.

Specifically, the operator places the process cartridge 9 above the process frame 31 and mounts the process cartridge 9 downward into the process frame 31.

Next, the operator pushes the process unit 4 rearward into the main casing 2.

Through this operation, the process-side positioning shaft 34 is fitted into the fitting grooves 86 formed in the body-side positioning plates 81 and the body-side positioning shaft 82 is fitted into the fitting grooves 43 formed in the process-side positioning plates 33, as the process unit 4 is shifted into its mounted position.

Next, the operator pushes the front end of the belt unit 20 downward.

As a result, the belt unit 20 pivots counterclockwise in a right side view about the rotational shaft 22A of the drive roller 22 until arriving in the contact position illustrated in FIGS. 1 and 2. The upper cover 80 also follows the pivoting movement of the belt unit 20, pivoting counterclockwise in a right side view about its rear edge.

Through this operation, the intermediate transfer belt 24 is placed in contact with the top surfaces of the photosensitive drums 11, and the conveying cylinder 69 is fitted into the receiving part 48, as described above.

As a consequence, the bottom end of the belt-cleaner-side shutter 70 contacts the top end of the receiving part 48 and the belt-cleaner-sidle shutter 70 moves into the open position against the urging force of the compression spring 73. Further, the bottom end of the conveying cylinder 69 contacts the top end of the drum-cleaner-side shutter 50, moving drum-cleaner-side shutter 50 into the open position against the urging force of the compression spring 51. At this time, the drum-cleaner-side communication hole 71 is aligned with the drum-cleaner-side through-hole 49 in the left-right direction.

This completes the operation to mount a process cartridge 9 in the main casing 2.

7. Operational Advantages (1) According to the printer 1, the waste toner storage unit 45, which stores residual toner from the belt cleaner 61, is provided in the black process cartridge 9K retained in the process frame 31, as shown in FIGS. 1 and 4.

Hence, maintenance can be performed on the waste toner storage unit 45 efficiently at the same time maintenance is performed on the black process cartridge 9K.

Additionally, the operation for separating the belt unit 20 from the photosensitive drums 11 can be used to interrupt the conveyance of residual toner from the belt cleaner 61 to the waste toner storage unit 45.

Hence, maintenance can be performed on the waste toner storage unit 45 after performing a simple operation.

In this way, the configuration of the embodiment facilitates maintenance of the waste toner storage unit 45, which stores residual toner from the belt cleaner 61.

(2) According to the printer 1, as shown in FIGS. 1 and 4, the process frame 31 can move between a mounted position inside the main casing 2 (FIG. 1) and a withdrawn position outside of the main casing 2 (FIG. 4).

Hence, maintenance can be performed on the process framed 31 after the process frame 31 is pulled out of the main casing 2.

Thus, this construction facilitates maintenance the process frame 31.

(3) According to the printer 1, as shown in FIG. 2, the conveying unit 63 is disposed adjacent to the left side of the belt unit 20.

Accordingly, space on the left side of the charging roller 12 can be used efficiently for disposing the conveying unit 63.

(4) According to the printer 1, as shown in FIG. 4, the belt unit 20 can pivot about its rear end, i.e., the end that opposes the secondary transfer roller 21.

This configuration reduces the range over which the rear end of the belt unit 20 moves as the belt unit 20 pivots.

As a result, less space is required around the opposing parts of the intermediate transfer belt 24 and secondary transfer roller 21. In particular, the fixing unit 6 can be disposed directly above the secondary transfer roller 21 without interfering with the pivoting belt unit 20.

(5) According to the printer 1, as shown in FIG. 1, residual toner is conveyed from the belt cleaner 61 to the waste toner storage unit 45 of the forwardmost black process cartridge 9K.

In other words, the waste toner storage unit 45, which accommodates residual toner collected from the belt cleaner 61, is disposed adjacent to the photosensitive drum 11 for black, i.e., the photosensitive drum 11 furthest away from the pivot point of the belt unit 20 (the rear end of the belt unit 20).

Thus, the belt cleaner 61 can be retracted far from the waste toner storage unit 45 of the black process cartridge 9K when the belt unit 20 is pivoted.

With this configuration, the conveyance of residual toner from the belt cleaner 61 to the waste toner storage unit 45 of the black process cartridge 9K can be reliably interrupted.

(6) According to the printer 1, when the belt unit 20 is disposed in the separated position shown in FIG. 4, the belt-cleaner-side shutter 70 can close the belt-cleaner-side communication hole 71 formed in the conveying unit 63 and the drum-cleaner-side shutter 50 can close the drum-cleaner-side through-hole 49 formed in the waste toner storage unit 45 of the black process cartridge 9K.

Accordingly, the conveyance of residual toner from the belt cleaner 61 to the waste toner storage unit 45 of the black process cartridge 9K can be reliably interrupted when the belt unit is disposed in its separated position. This configuration also reliably prevents toner from leaking out through the belt-cleaner-side communication hole 71.

(7) According to the printer 1, when the belt unit 20 is disposed in the separated position shown in FIG. 4, the conveying unit 63 is retracted together with the belt unit 20 from the path of the process unit 4.

Hence, the conveying unit 63 can be reliably retracted from the path of the process unit 4 by pivoting the belt unit 20.

Thus, after placing the belt unit 20 in its separated position, the process unit 4 can be smoothly moved in an out of the main casing 2.

(8) According to the printer 1, as shown in FIG. 4, maintenance can be performed on the waste toner storage unit 45, which accommodates residual toner collected room the belt cleaner 61, at the same time maintenance is performed on the black process cartridge 9K.

Accordingly, the construction of the embodiment better facilitates maintenance of the waste toner storage unit 45.

8. Second Embodiment

Next, a second embodiment of the present invention will be described with reference to FIGS. 5-7, wherein like parts and components are designated with the same reference numerals to avoid duplicating description.

(1) Overall Description of the Printer

In the first embodiment described above, the drum cleaner 44 having the waste toner storage unit 45 is provided for each of the process cartridges 9, and residual toner cleaned off the intermediate transfer belt 24 is conveyed from the belt cleaner 61 to the waste toner storage unit 45 of the black process cartridge 9K.

In the second embodiment, a waste toner storage unit 91 is provided solely for a black developer cartridge 90 among the plurality of developer cartridges 90, and residual toner cleaned off the intermediate transfer belt 24 is conveyed to the waste toner storage unit 91.

(2) Detailed Description of the Printer in the Second Embodiment (2-2) Overall Structure In the second embodiment, scorotron charges 92 are provided in place of the charging rollers 12 in the first embodiment, and drum-cleaning rollers 93 are provided in place of the drum cleaners 44.

Each scorotron charge 92 is disposed in a position opposing but separated from the lower rear side of the corresponding photosensitive drum 11.

Each drum-cleaning roller 93 is disposed on the rear side of the corresponding photosensitive drum 11 so as to contact the photosensitive drum 11 from the rear.

The photosensitive drums 11, scorotron chargers 92, and drum-cleaning rollers 93 are permanently (i.e., non-detachably) retained in the process frame 31.

Also in the second embodiment, the developer cartridges 90 are provided in place of the developing devices 13 described in the first embodiment.

Other than being detachably mountable in the process frame 31, the developer cartridges 90 have the same configuration as the developing devices 13. That is, the developer cartridges 90 function to supply toner to the corresponding photosensitive drums 11 during an image-forming operation.

In the second embodiment, an opening 107 is formed in the right side wall 35 of the process frame 31 for mounting and removing the developer cartridges 90.

(2-2) Detailed Description of the Process Unit

The waste toner storage unit 91 is integrally provided on the front side of the black developer cartridge 90. The waste toner storage unit 91 has a box-like shape and is elongated in the left-right direction. The waste toner storage unit 91 is also provided with a coupling part 95.

The coupling part 95 is provided on the right sided of the waste toner storage unit 91. The coupling part 95 is box-like shaped and expands above the left side of the waste toner storage unit 91.

The process frame 31 includes a relay member 94.

The relay member 94 is disposed in the approximate left-right center of the process frame 31 on the front end thereof. The relay member 94 includes a receiving part 96, a conveyance tube 98, a coupling part 97, and an auger screw 102.

The receiving part 96 is integrally provided on the rear side of the front wall 36 in the left-right center thereof. The receiving part 96 has a general cylindrical shape that is closed on the bottom and is elongated vertically. The receiving part 96 has a relay-member-side communication hole 99, and a relay-member-side shutter 100.

The relay-member-side communication hole 99 has a general rectangular shape in a side view and penetrates the rear wall of the receiving part 96 on the upper end thereof.

The relay-member-side shutter 100 is disposed inside the receiving part 96. The relay-member-side shutter 100 has a general cylindrical shape with a closed top and is elongated vertically. The vertical length of the relay-member-side shutter 100 is approximately half that of the receiving part 96. The relay-member-side shutter 100 is capable of sliding between an open position (see FIG. 5) in which the relay-member-side shutter 100 is disposed in the lower end of the receiving part 96 for opening the relay-member-side communication hole 99, and a closed position (see FIG. 7) in which the relay-member-side shutter 100 is disposed in the upper end of the receiving part 96 for closing the relay-member-side communication hole 99. A compression spring 101 is interposed between the bottom wall of the receiving part 96 and the top wall of the relay-member-side shutter 100 for constantly urging the relay-member-side shutter 100 upward toward the closed position.

The conveyance tube 98 has a general cylindrical shape and extends first rearward from the rear peripheral side of the relay-member-side communication hole 99, bends and extends downward, and again bends and extends rightward.

The coupling part 97 has a general cylindrical shape that is oriented in the left-right direction. The coupling part 97 is formed continuously with the right end of the conveyance tube 98. The right end of the coupling part 97 is detachably coupled with the coupling part 95 of the waste toner storage unit 91.

The auger screw 102 is disposed inside the lower end of the conveyance tube 98 and the coupling part 97 and is oriented in the left-right direction.

(2-3) Detailed Description of the Belt Unit

In the belt cleaner 61 according to the second embodiment, the cleaning unit 62 is disposed above the intermediate transfer belt 24 and is vertically aligned with the black photosensitive drum 11. In place of the scraping blade 65 and scraping brush 66 described in the first embodiment, the cleaning unit 62 further includes a belt-cleaning roller 103, a relay roller 104, and a scraping blade 105.

The belt-cleaning roller 103 is disposed inside the rear end of the cleaner frame 64 at a position opposing the collection hole 68 from above. The belt-cleaning roller 103 contacts the top of the upper portion constituting the intermediate transfer belt 24.

The relay roller 104 is disposed on the rear side of the auger screw 67 and the front side of the belt-cleaning roller 103 and contacts the front side of the belt-cleaning roller 103.

The scraping blade 105 has a generally flat plate shape that is elongated in the left-right direction. The scraping blade 105 is disposed on the rear side of the auger screw 67 and the front side of the relay roller 104. The top end (i.e., base end) of the scraping blade 105 is supported on the top wall of the cleaner frame 64. The bottom end (i.e., free end) of the scraping blade 105 contacts the front side of the relay roller 104.

In the belt cleaner 61 according to the second embodiment, the cleaner frame 64 includes a connecting part 106 disposed in its left-right center.

The connecting part 106 has a generally square cylindrical shape and protrudes forward from the front end of the cleaner frame 64 in approximately the left-right center thereof. The rear end of the connecting part 106 is in communication with the cleaner frame 64.

In the belt cleaner 61 according to the second embodiment, the auger screw 67 extends in the left-right direction. The right half of the auger screw 67 is formed with a right-handed screw shape, while the left half is formed with a left-handed screw shape for conveying residual toner toward the left-right center of the auger screw 67. The right end of the auger screw 67 is rotatably supported in the right wall of the cleaner frame 64, and the left end of the auger screw 67 is rotatably supported in the left wall of the cleaner frame 64.

In the belt cleaner 61 according to the second embodiment, the conveying unit 63 is formed continuously with the front end of the connecting part 106 constituting the cleaning unit 62. The conveying unit 63 is disposed on the front side of the intermediate transfer belt 24 in the approximate left-right center thereof. The conveying unit 63 and the relay member are configured of a conveying member (not shown).

Figure 5:
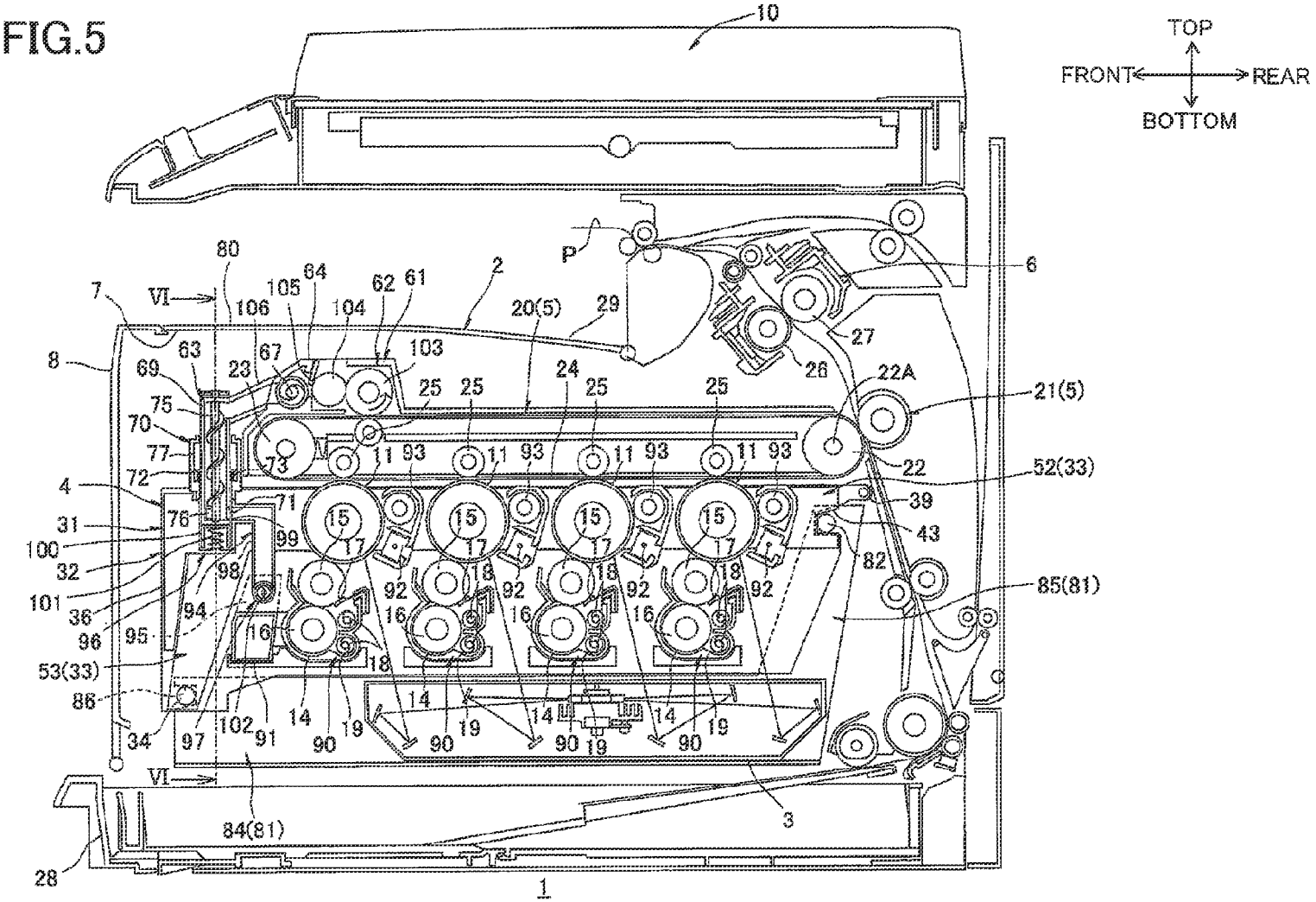
FIG. 5 is a vertical cross-sectional view of a printer according to a second embodiment.

When the process unit 4 is disposed in the mounted position and the belt cleaner 61 is disposed in the contact position, the bottom end of the conveying cylinder 69 is fitted into the receiving part 96 of the relay member 94, as shown in FIG. 5, whereby the conveying unit 63 is coupled to the relay member 94.

At this time, the bottom en of the belt-cleaner-side shutter 70 contacts the top end of the receiving part 96 and is disposed in the open position against the urging force of the compression spring 73.

Further, the top end of the relay-member-side shutter 100 contacts the bottom end of the conveying cylinder 69 and is disposed in the open position against the urging force of the compression spring 101.

Accordingly, the belt-cleaner-side communication hole 71 is aligned with the relay-member-side communication hole 99 in the front-rear direction.

(2-4) Cleaning Operation

During an image-forming operation on the printer 1 according to the second embodiment, the drum-cleaning rollers 93 clean the surfaces of the corresponding photosensitive drums 11, and the belt cleaner 61 cleans the surface of the intermediate transfer belt 24. A cleaning bias is also applied to both the drum-cleaning rollers 93 and the belt-cleaning roller 103.

In the image-forming operation described above, toner remaining on the surface of each photosensitive drum 11 after the toner image carried on the photosensitive drum 11 is transferred to the lower portion of the intermediate transfer belt 24 is electrostatically attracted to the surface of the corresponding drum-cleaning roller 93 as the photosensitive drum 11 rotates clockwise in a right side view.

Also in the image-forming operation, toner remaining on the surface of the intermediate transfer belt 24 after the color image carried on the intermediate transfer belt 24 is transferred onto the paper P is electrostatically attracted to the surface of the belt-cleaning roller 103 as the intermediate transfer belt 24 continues to circulate.

The residual toner retained on the belt-cleaning roller 103 is subsequently attracted electrically to the relay roller 104. Thereafter, the scraping blade 105 scrapes the residual toner off the relay roller 104, and the toner is conveyed to the front end of the cleaner frame 64.

The auger screw 67 rotates to convey toner from the front end of the cleaner frame 64 toward the left-right center thereof in order to supply the toner into the top end of the conveying cylinder 69 through the connecting part 106.

Toner supplied into the conveying cylinder 69 if conveyed downward by its own weight and the rotating auger screw 75. The blade 76 at the bottom of the auger screw 75 supplies the toner into the conveyance tube 98 of the relay member 94 through the belt-cleaner-side communication hole 71 and relay-member-side communication hole 99.

Residual toner supplied into the conveyance tube 98 drops downward through the conveyance tube 98 and is conveyed through the coupling part 97 by the rotating auger screw 102 and stored in the waste toner storage unit 91.

In other words, when the belt unit 20 is in the contact position, the conveying unit 63 allows residual toner to be conveyed from the cleaning unit 62 to the waste toner storage unit 91.

Further, while the image-forming operation described above is not being executed, residual toner retained electrostatically on the surface of the drum-cleaning rollers 93 is collected in the waste toner storage unit 91.

More specifically, residual toner retained on the drum-cleaning rollers 93 is expelled onto the surfaces of the corresponding photosensitive drums 11 by a controlled cleaning bias applied to the drum-cleaning rollers 93.

As each photosensitive drum 11 continues to rotate, the residual toner expelled onto the peripheral surface of the photosensitive drum 11 comes into confrontation with the intermediate transfer belt 24.

At this time, the residual toner is transferred from the surface of the photosensitive drum 11 onto the surface of the intermediate transfer belt 24.

As described above, residual toner transferred onto the surface of the intermediate transfer belt 24 is electrically attracted to the surface of the belt-cleaning roller 103 as the intermediate transfer belt 24 circulates, and is subsequently scraped off the relay roller 104 by the scraping blade 105 and collected in the cleaner frame 64.

Thereafter, residual toner collected in the cleaner frame 64 is conveyed toward the left-right center of the same by the rotating auger screw 67, conveyed little by little through the conveying cylinder 69 and relay member 95, and stored in the waste toner storage unit 91.

(2-5) Mounting and Removing the Developer Cartridges

In order to remove a developer cartridge 90 from the main casing 2, first the operator opens the front cover 8 and lifts the front end of the belt unit 20 upward.

Figure 7:
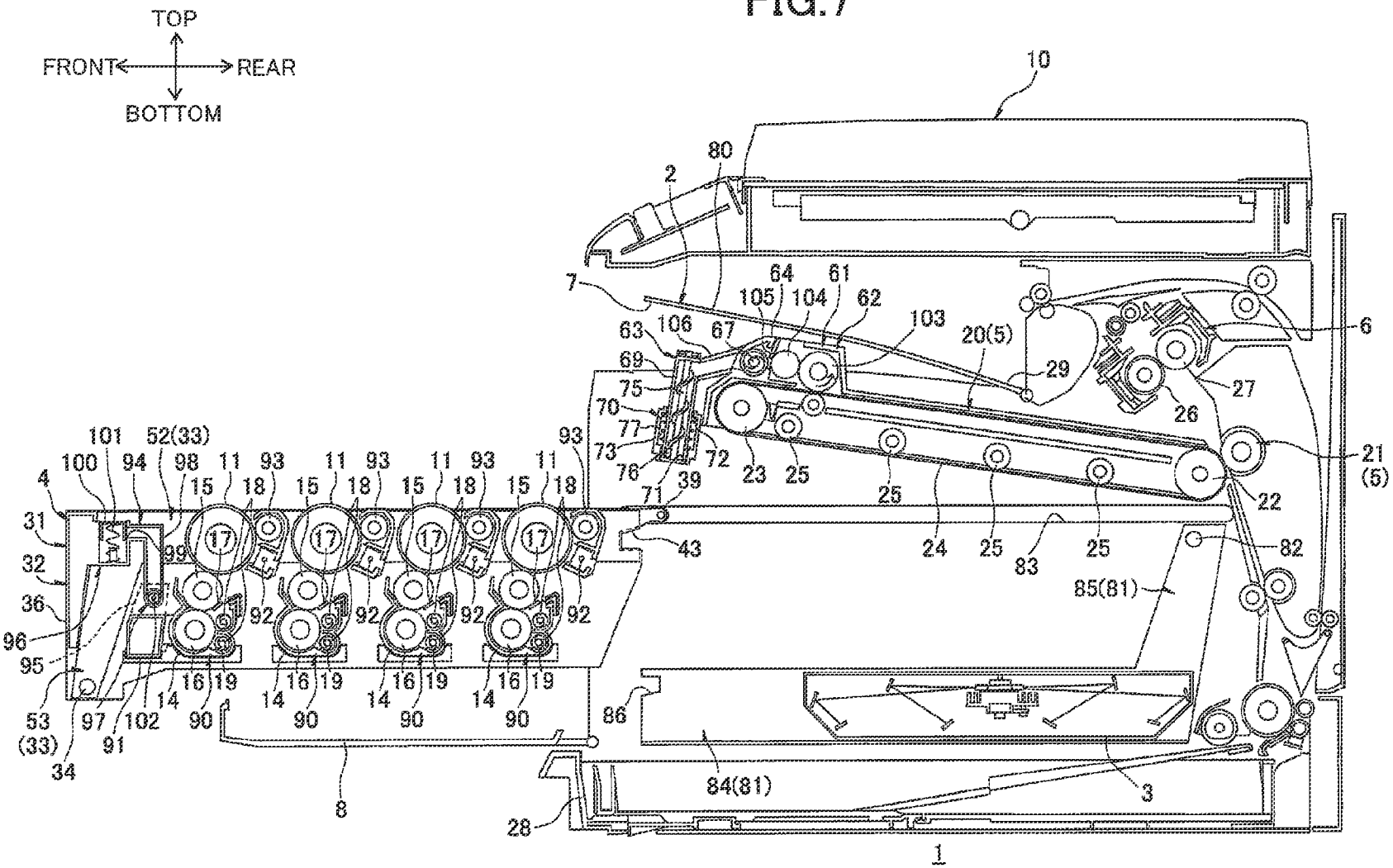
FIG. 7 is a an explanatory diagram showing a mounting and removing operation of a process cartridge shown in FIG. 5.

Consequently, the belt unit 20 pivots clockwise in a right side view about the rotational shaft 22A of the drive roller 22, as shown in FIG. 7, moving to its separated position. The upper cover 80 follows the pivoting belt unit 20 by pivoting clockwise in a right side view about its rear edge.

Through this operation, the intermediate transfer belt 24 separates from the top surfaces of the photosensitive drums 11. The conveying cylinder 69 also moves upward, separating from the relay member 94. Hence, the conveying cylinder 69 is extracted from the receiving part 96.

Thus, when the belt unit 20 is shifted into its separated position, the conveying unit 63 moves upward together with the belt unit 20 and is retracted from the path of the process unit 4.

As a result, the urging force of the compression spring 73 moves the belt-cleaner-side shutter 70 into its closed position, and the urging force of the compression spring 101 moves the relay-member-side shutter 100 into its closed position.

This action blocks the conveyance of residual toner from the cleaning unit 62 to the waste toner storage unit 91.

Next, to remove the developer cartridge 90 from the main casing 2, the operator pulls the process unit 4 forward out of the main casing 2.

Through this operation, the process-side positioning shaft 34 is extracted from the fitting grooves 86 formed in the body-side positioning plates 81 and the body-side positioning shaft 82 is extracted from the fitting grooves 43 formed in the process-side positioning plates 33, as the process unit 4 is shifted into the withdrawn position.

Next, the operator pulls the developer cartridge 90 rightward out of the process frame 31 through the opening 107, thereby completing the operation to remove a developer cartridge 90 from the main casing 2.

In order to mount a developer cartridge 90 in the main casing 2, the operation for removing a developer cartridge 90 described above is performed in reverse.

Specifically, the operator places the developer cartridge 90 in position on the right side of the process frame 31 and mounts the developer cartridge 90 into the process frame 31 via the opening 107.

Next, the operator pushes the process unit 4 reserved into the main casing 2.

Through this operation, the process-side positioning shaft 34 is fitted into the fitting grooves 86 formed in the body-side positioning plates 81 and the body-side positioning shaft 82 is fitted into the fitting grooves 43 formed in the process-side positioning plates 33, as the process unit 4 is shifted into its mounted position.

Next, the operator pushes the front end of the belt unit 20 downward.

Figure 6:
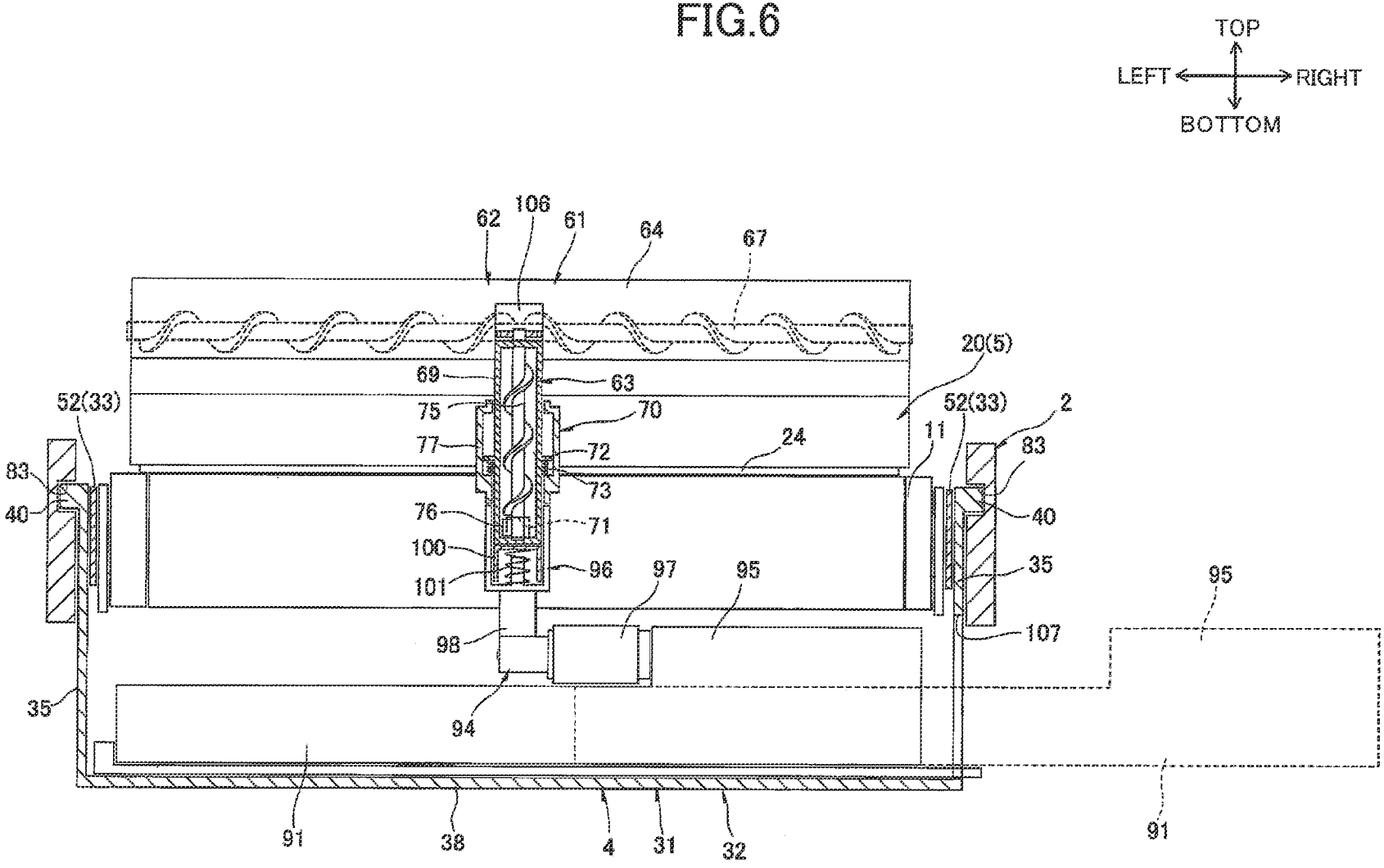
FIG. 6 is a cross-sectional view taken along a VI-VI line of FIG. 5.

As a result, the belt unit 20 pivots counterclockwise in a right side view about the rotational shaft 22A of the drive roller 22 until arriving in the contact position illustrated in FIGS. 5 and 6. The upper cover 80 also follows the pivoting movement of the belt unit 20, pivoting counterclockwise in a right side view about its rear edge.

Through this operation, the intermediate transfer belt 24 is placed in contact with the top surfaces of the photosensitive drums 11, and the conveying cylinder 69 is fitted into the receiving part 96, as described above.

As a consequence, the bottom end of the belt-cleaner side shutter 70 contacts the top end of the receiving part 96 and the belt-cleaner-side shutter 70 moves into the open position against the urging force of the compression spring 73. Further, the bottom end of the conveying cylinder 69 contacts the top end of the relay-member-side shutter 100, moving the relay-member-side shutter 100 into the open position against the urging force of the compression spring 101. At this time, the belt-cleaner-side communication hole 71 is aligned with the relay-member-side communication hole 99 in the front-rear direction.

This completes the operation to mount a developer cartridge 90 in the main casing 2.

(3) Operational Advantages of the Second Embodiment (3-1) According to the second embodiment, as shown in FIG. 5, the conveying unit 63 is disposed adjacent to the front side of the belt unit 20 in the left-right center of the photosensitive drums 11, i.e., within the left-right dimension of the photosensitive drums 11.

Accordingly, space on the front side of the belt unit 20 can be used efficiently for disposing the conveying unit 63.

(3-2) According to the second embodiment, when the belt unit 20 is disposed in the separated position shown in FIG. 7, the belt-cleaner-side shutter 70 can close the belt-cleaner-side communication hole 71 formed in the conveying unit 63 and the relay-member-side shutter 100 can close the relay-member-side communication hole 99 formed in the relay member 94.

Accordingly, the conveyance of residual toner from the belt cleaner 61 to the waste toner storage unit 91 can be reliably interrupted by placing the belt unit 20 in its separated position. This configuration also reliably prevents toner from leaking out through the belt-cleaner-side communication hole 71 and relay-member-side communication hole 99.

(3-3) According to the second embodiment, the waste toner storage unit 91 coupled to the relay member 94 can be detached therefrom, as illustrated by the dashed lines in FIG. 6.

Accordingly, the waste toner storage unit 91 can be separated from the process unit 4 together with the developer cartridge 90 so that maintenance can be performed on the waste toner storage unit 91 separate from the relay member 94.

(3-4) According to the second embodiment, maintenance can be performed on the waste toner storage unit 91 at the same time maintenance is performed on the black developer cartridge 90.

Accordingly, the construction of the second embodiment better facilitates maintenance of the waste toner storage unit 91.

(3-5) The printer 1 according to the second embodiment obtains the same operational advantages described in the first embodiment.

While the invention has been described in detail with reference to the embodiments thereof, it would be apparent to those skilled in the art that various changes and modifications may be made therein without departing from the spirit of the invention.

What is claimed is:

1. An image forming device comprising:

a main body;

a cartridge configured to retain a photosensitive body extending in a longitudinal direction and having a longitudinal dimension;

a supporting member configured to support the cartridge;

a belt unit comprising:

a belt; and a cleaning member configured to remove residual toner remaining on the belt;

a waste toner storage member supported by the supporting member and configured to store the residual toner removed by the cleaning member; and a conveying member configured to convey the residual toner removed by the cleaning member to the waste toner storage member, wherein the belt unit is configured to be movable between a contact position in which the belt contacts the photosensitive body and a separated position in which the belt is separated from the photosensitive body, wherein the conveying member is provided in the belt unit, coupled to the waste toner storage member when the belt unit is disposed in the contact position, and separated from the waste toner storage member when the belt unit is disposed in the separated position, wherein the conveying member is formed with a first opening, and a first shutter member is configured to open the first opening when the belt unit is disposed in the contact position and close the first opening when the belt unit is disposed in the separated position, wherein the waste toner storage member is formed with a second opening, and a second shutter member is configured to open the second opening when the belt unit is disposed in the contact position and close the second opening when the belt unit is disposed in the separated position, and wherein the waste toner storage member, which is supported by the supporting member configured to support the cartridge and in which the residual toner removed from the belt unit by the cleaning member is stored, is disposed beneath the belt unit and is closer to the belt unit when the belt unit is disposed in the contact position than when the belt unit is disposed in the separated position.

2. The image forming device according to claim 1, wherein the supporting member is configured to be movable between an inside position inside the main body and an outside position outside the main body.

3. The image forming device according to claim 2, wherein the conveying member is disposed adjacent to the belt unit in the longitudinal direction of the photosensitive body.

4. The image forming device according to claim 2, wherein the conveying member is disposed adjacent to the belt unit in a downstream side of a moving direction of the supporting member moving from the inside position to the outside position and within the longitudinal dimension of the photosensitive body.

5. The image forming device according to claim 2, further comprising:

a transfer member configured to oppose the belt unit in an upstream side of a moving direction of the supporting member moving from the inside position to the outside position, wherein the belt unit has an upstream end in the moving direction, and is configured to be pivotable about the upstream end between the contact position and the separated position.

6. The image forming device according to claim 2, wherein the photosensitive body includes a plurality of photosensitive units arranged at an equal-interval and in parallel to one another in a moving direction of the supporting member moving from the inside position to the outside position, and wherein the waste toner storage member is disposed adjacent to the farthest downstream one of the plurality of photosensitive units in the moving direction.

7. The image forming device according to claim 1, wherein the conveying member is configured to be retractable from a moving path of the supporting member together with the belt unit when the belt unit is disposed in the separated position.

8. The image forming device according to claim 1, wherein the conveying member comprises:

a first conveying member provided in the belt unit; and a second conveying member provided in the supporting member and detachably coupled to the first conveying member, wherein the first conveying member is formed with the first opening, and wherein the second conveying member is formed with a third opening configured to oppose the first opening when the belt unit is disposed in the contact position, and a third shutter member is configured to open the third opening when the belt unit is disposed in the contact position and close the third opening when the belt unit is disposed in the separated position.

9. The image forming device according to claim 8, wherein the first conveying member is configured to be retractable from a moving path of the supporting member together with the belt unit when the belt unit is disposed in the separated position.

10. The image forming device according to claim 8, wherein the second conveying member is detachably coupled to the waste toner storage member.

11. The image forming device according to claim 1, wherein the waste toner storage member is detachably mounted in the supporting member together with the photosensitive body.

12. The image forming device according to claim 1, wherein the photosensitive body includes a plurality of photosensitive units, and wherein the waste toner storage member is detachably mounted in the supporting member together with one of the plurality of photosensitive units.

13. The image forming device according to claim 1, further comprising:

a developer cartridge provided corresponding to the photosensitive body, the developer cartridge being configured to supply toner onto the photosensitive body, wherein the waste toner storage member is detachably mounted in the supporting member together with the developer cartridge.

14. The image forming device according to claim 1, further comprising:

a plurality of developer cartridges, wherein the photosensitive body includes a plurality of photosensitive units, wherein the plurality of developer cartridges is provided in one-to-one correspondence with the plurality of photosensitive units, each of the plurality of developer cartridges being configured to supply toner onto a corresponding one of the plurality of photosensitive units, and wherein the waste toner storage member is detachably mounted in the supporting member together with one of the plurality of developer cartridges.

15. An image forming device comprising:

a main body;

a cartridge configured to retain a photosensitive body extending in a longitudinal direction and having a longitudinal dimension;

a supporting member configured to support the cartridge;

a belt unit comprising:

a belt; and a cleaning member configured to remove residual toner remaining on the belt;

a waste toner storage member supported by the supporting member and configured to store the residual toner removed by the cleaning member; and a conveying member configured to convey the residual toner removed by the cleaning member to the waste toner storage member, wherein the belt unit is configured to be movable between a contact position in which the belt contacts the photosensitive body and a separated position in which the belt is separated from the photosensitive body, wherein the conveying member is configured to allow the residual toner to be conveyed from the cleaning member to the waste toner storage member when the belt unit is in the contact position, and interrupt the residual toner from being conveyed from the cleaning member to the waste toner storage member when the belt unit is in the separated position, and wherein the waste toner storage member, which is supported by the supporting member configured to support the cartridge and in which the residual toner removed from the belt unit by the cleaning member is stored, is disposed beneath the belt unit and is closer to the belt unit when the belt unit is disposed in the contact position than when the belt unit is disposed in the separated position.

16. The image forming device according to claim 15, wherein the supporting member is configured to be movable between an inside position inside the main body and an outside position outside the main body.

17. The image forming device according to claim 16, wherein the conveying member is disposed adjacent to the belt unit in the longitudinal direction of the photosensitive body.

18. The image forming device according to claim 16, wherein the conveying member is disposed adjacent to the belt unit in a downstream side of a moving direction of the supporting member moving from the inside position to the outside position and within the longitudinal dimension of the photosensitive body.

19. The image forming device according to claim 16, further comprising:

a transfer member configured to oppose the belt unit in an upstream side of a moving direction of the supporting member moving from the inside position to the outside position, wherein the belt unit has an upstream end in the moving direction, and is configured to be pivotable about the upstream end between the contact position and the separated position.

20. The image forming device according to claim 16, wherein the photosensitive body includes a plurality of photosensitive units arranged at an equal-interval and in parallel to one another in a moving direction of the supporting member moving from the inside position to the outside position, and wherein the waste toner storage member is disposed adjacent to the farthest downstream one of the plurality of photosensitive units in the moving direction.

* * * * *